US010937360B2

(12) United States Patent
Lee et al.

(10) Patent No.: US 10,937,360 B2
(45) Date of Patent: Mar. 2, 2021

(54) SOURCE DRIVER FOR DISPLAY APPARATUS

(71) Applicant: SILICON WORKS CO., LTD., Daejeon-si (KR)

(72) Inventors: Jae Kwan Lee, Seoul (KR); Kyung Min Kim, Daejeon-si (KR)

(73) Assignee: Silicon Works Co., Ltd., Daejeon-si (KR)

( * ) Notice: Subject to any disclaimer, the term of this patent is extended or adjusted under 35 U.S.C. 154(b) by 594 days.

(21) Appl. No.: 15/409,744

(22) Filed: Jan. 19, 2017

(65) Prior Publication Data

US 2017/0206833 A1 Jul. 20, 2017

(30) Foreign Application Priority Data

Jan. 20, 2016 (KR) ..... 10-2016-0006826
Jan. 17, 2017 (KR) ..... 10-2017-0008005

(51) Int. Cl.
*G09G 3/32* (2016.01)

(52) U.S. Cl.
CPC ..... *G09G 3/32* (2013.01); *G09G 2310/027* (2013.01); *G09G 2320/0295* (2013.01); *G09G 2320/0693* (2013.01)

(58) Field of Classification Search
CPC ..... G09G 3/32; G09G 2310/027; G09G 2320/0295; G09G 2320/0693; G09G 3/30; G09G 3/20; H01L 51/50; G06F 3/042
See application file for complete search history.

(56) References Cited

U.S. PATENT DOCUMENTS

2006/0139264 A1* 6/2006 Choi ..... G09G 3/3283 345/76
2007/0120780 A1* 5/2007 Park ..... G09G 3/3291 345/76
2009/0051628 A1* 2/2009 Kwon ..... G09G 3/3233 345/77
2010/0295832 A1 11/2010 Nishio et al.
2012/0086739 A1 4/2012 Akimoto et al.
2012/0199724 A1* 8/2012 Nomura ..... H04N 5/3454 250/208.1
2015/0262546 A1* 9/2015 Ogura ..... G09G 3/3275 345/205
2016/0104428 A1* 4/2016 In ..... G09G 3/3291 345/214

(Continued)

FOREIGN PATENT DOCUMENTS

CN 102005169 A 4/2011
CN 103531160 A 1/2014

(Continued)

*Primary Examiner* — Lunyi Lao
*Assistant Examiner* — Jarurat Suteerawongsa
(74) *Attorney, Agent, or Firm* — Polsinelli PC

(57) ABSTRACT

The present invention discloses a source driver for a display apparatus, which drives a display panel using display data and senses a pixel signal of the display panel. The source driver may include a sensor and ADC (Analog-digital Converter) which provide the pixel sensing signal obtained by comparing a reference voltage and a pixel signal of the display panel using one buffer at a sensing period, and drive the source signal to the display panel using the buffer at a driving period.

13 Claims, 4 Drawing Sheets

(56) References Cited

U.S. PATENT DOCUMENTS

| | | | | |
|---|---|---|---|---|
| 2016/0125792 | A1* | 5/2016 | Lee | G09G 3/2096 345/212 |
| 2016/0240122 | A1 | 8/2016 | Yu et al. | |
| 2018/0352178 | A1* | 12/2018 | Kato | H04N 5/357 |

FOREIGN PATENT DOCUMENTS

| | | | |
|---|---|---|---|
| CN | 104036723 | A | 9/2014 |
| CN | 105047137 | A | 11/2015 |
| JP | 2011-81313 | | 4/2011 |
| KR | 10-2016-0066108 | | 6/2016 |

* cited by examiner

SOURCE DRIVER FOR DISPLAY APPARATUS

BACKGROUND

1. Technical Field

The present disclosure relates to a source driver, and more particularly, to a source driver for a display apparatus, which drives a display panel using display data and senses a pixel signal of the display panel.

2. Related Art

A flat panel display device includes a source driver to provide a source signal for displaying data on a display panel. The source driver is configured to convert display data provided from an external source such as a timing controller into a source signal, and provide the source signal to the display panel.

The display panel may include an LCD (Liquid Crystal Display) panel or LED (Light Emitting Diode) panel. The LCD panel displays a screen using an optical shutter operation of liquid crystal at each pixel, and the LED panel displays a screen by controlling light emission of the LED at each pixel.

For the LED panel, the source driver is configured to sense the characteristics of pixels in the LED panel. When the source driver provides sensing data corresponding to the pixel characteristics, a timing controller or application processor corrects display data using the sensing data. Then, the source driver drives the display panel using the corrected display data. Therefore, an image of the display panel can be expressed with a good quality, while the influence on the pixel characteristics is reduced.

For this operation, the source driver includes a sensor configured to output a sensing signal for the characteristic of a pixel and an analog-digital converter (ADC) configured to output sensing data by determining the sensing signal. In the source driver, the ADC is implemented separately from a source driving module for processing display data. The source driving module includes digital circuits for generating a source signal corresponding to display data.

The source driving module, the sensor and the ADC are implemented at each channel of the source driver that outputs a source signal to the display panel. The source driver provides source signals to the display panel and receives pixel signals, through a large number of channels. Therefore, the source driver fabricated as an integrated circuit includes a large number of sensors corresponding to the number of channels.

Since the sensors are implemented at the respective channels of the source driver, the sensors occupy a large area in the source driver. Therefore, the sensors serve as a factor that increases the area of the source driver fabricated as an integrated circuit.

Furthermore, since the sensors occupy a large proportion in the limited area of the integrated circuit, there are difficulties in efficiently designing internal circuits of the source driver.

SUMMARY

Various embodiments are directed to a source driver for a display apparatus, which is capable of outputting a source signal of a source driving module to a display panel or receiving a pixel signal of the display panel using one buffer, thereby reducing an area required for design while internal circuits are efficiently designed.

Also, various embodiments are directed to a source driver for a display apparatus, which is capable of outputting a source signal of a source driving module to a display panel or sensing a pixel signal of a display panel using one buffer, thereby reducing an area required for design while internal circuits are efficiently designed.

In an embodiment, a source driver for a display apparatus may include: a source driving module configured to generate a source signal corresponding to display data; a conversion module configured to generate sensing data corresponding to a pixel sensing signal; and a hybrid buffer circuit including a buffer and configured to provide the pixel sensing signal obtained by comparing a reference voltage and a pixel signal of a display panel using the buffer at a sensing period, and drive the source signal to the display panel using the buffer at a driving period.

In another embodiment, a source driver for a display apparatus may include: a buffer having first and second input terminals and an output terminal configured to output a source signal or pixel sensing signal; a first selection circuit configured to provide a reference voltage to the first input terminal at a sensing period and provide the source signal to the first input terminal at a driving period, the source signal being outputted from a DAC (Digital-Analog Converter) in response to display data; a second selection circuit configured to provide a pixel signal of a display panel to the second input terminal at the sensing period and form a feedback path between the output terminal and the first input terminal at the driving period; an ADC configured to receive the pixel sensing signal of the output terminal and generate sensing data by analog-digital converting the pixel sensing signal; and a third selection circuit configured to transmit the pixel sensing signal of the output terminal to the ADC at the sensing period, and transmit the source signal of the output terminal to the display panel at the driving period.

In another embodiment, a source driver for a display apparatus may include: a buffer having first and second input terminals and an output terminal configured to output a source signal or pixel sensing signal; a first selection circuit configured to provide a reference voltage to the first input terminal at a sensing period and provide the source signal to the first input terminal at a driving period, the source signal being outputted from a DAC in response to display data; a second selection circuit configured to provide a pixel signal of a display panel to the second input terminal at the sensing period and form a feedback path between the output terminal and the first input terminal at the driving period; a sensor configured to receive the pixel sensing signal of the output terminal, sense the pixel sensing signal, and provide a sensing signal for conversion into sensing data; and a third selection circuit configured to transmit the pixel sensing signal of the output terminal to the sensor at the sensing period, and transmit the source signal of the output terminal to the display panel at the driving period.

According to the embodiments of the present invention, one buffer may be used to output a source signal to the display panel at the driving period or receive or sense a pixel signal at the sensing period. Thus, the area required for designing the configuration of the source driving module and the sensor at each channel can be reduced, while the internal circuits of the source driver are efficiently designed.

DETAILED DESCRIPTION

Figure 1:
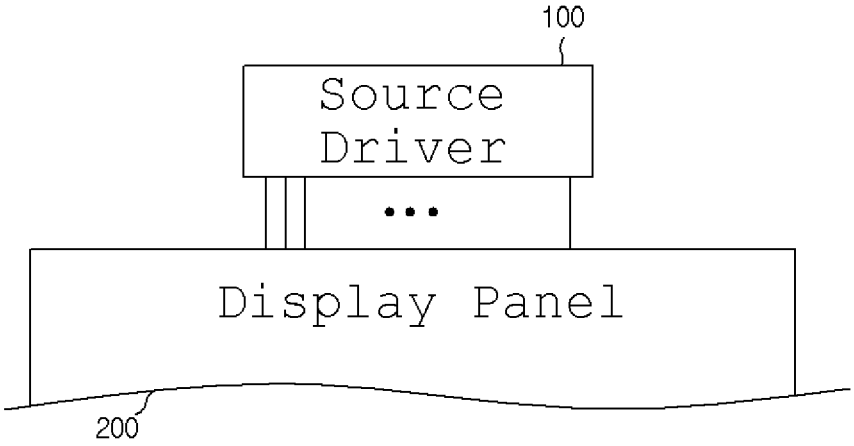
FIG. 1 is a diagram illustrating a state in which a source driver for a display apparatus according to an embodiment of the present invention is connected to a display panel.

Hereafter, embodiments of the present invention will be described in detail with reference to the accompanying drawings. The terms used in the present specification and claims are not limited to typical dictionary definitions, but must be interpreted into meanings and concepts which coincide with the technical idea of the present invention.

Embodiments described in the present specification and configurations illustrated in the drawings are preferred embodiments of the present invention, and do not represent the entire technical idea of the present invention. Thus, various equivalents and modifications capable of replacing the embodiments and configurations may be provided at the point of time that the present application is filed.

The embodiments of the present invention disclose a source driver for a flat panel display apparatus.

A source driver according to an embodiment of the present invention has a function of transmitting sensing data to a timing controller or application processor (not illustrated), the sensing data being obtained by converting pixel signals of a display panel such as an LED panel, which needs to sense the characteristics of pixels.

Referring to FIG. 1, a display apparatus includes a source driver 100 and a display panel 200, and is configured to output source signals from the source driver 100 to the display panel 200 and output sensing signals from the display panel 200 to the source driver 100.

The source driver 100 is configured to recover display data provided from an external source (not illustrated) such as a timing controller, and generate and output source signals using the recovered display data. The source signals are outputted through a plurality of channels of the source driver 100.

The source driver 100 receives sensing signals of the display panel 200 through the respective channels, and samples the received signals. Then, the source driver 100 converts the sampled signals into sensing data which are digital signals, and provides the sensing data to the timing controller or application processor.

The sensing data may be used for correcting display data to provide to the source driver 100. The source driver 100 may receive the corrected display data, and drive an image with a good quality to the display panel 200, without an influence on the characteristics of the display panel.

Figure 2:
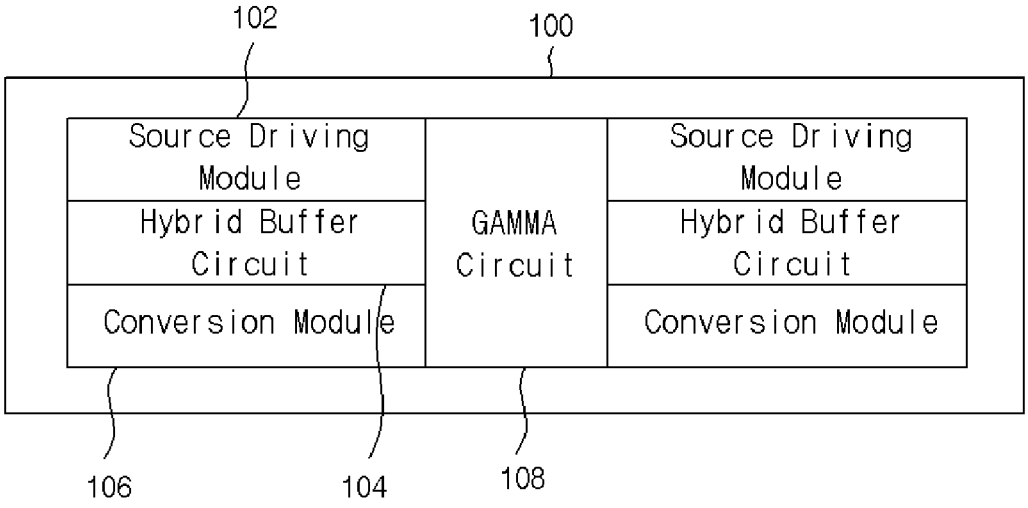
FIG. 2 is a block diagram illustrating a source driver for a display apparatus according to an embodiment of the present invention.

Referring to FIG. 2, the source driver 100 may include a source driving module 102, a hybrid buffer circuit 104, a conversion module 106 and a gamma circuit 108.

The source driver 100 may be designed in such a manner that the source driving module 102, the hybrid buffer circuit 104 and the conversion module 106 are arranged at either side of the gamma circuit 108.

The source driving module 102 recovers display data, and generates a source signal using the recovered display data.

The conversion module 106 generates sensing data corresponding to a pixel sensing signal.

The hybrid buffer circuit 104 includes a buffer 40 described later. The hybrid buffer circuit 104 is configured to provide a pixel sensing signal to the conversion module 106 at a sensing period, the pixel sensing signal obtained by comparing a reference voltage and a pixel signal of the display panel 200 using the buffer 40, and drive a source signal of the source driving module 102 to the display panel 200 using the buffer 40 at a driving period.

The gamma circuit 108 is configured to provide gamma voltages to the source driving module 102, and the source driving module 102 may generate a source signal by selecting a gamma voltage corresponding to display data.

The configurations of the source driving module 102, the hybrid buffer circuit 104 and the conversion module 106 will be described in detail with reference to FIG. 3.

The source driving module 102, the hybrid buffer circuit 104 and the conversion module 106 are implemented at each channel of the source driver 100, which outputs a source signal. That is, the source driving module 102 and the hybrid buffer circuit 104 may be implemented at each channel for outputting a source signal of the source driver 100, and the conversion module 106 and the hybrid buffer circuit 104 may be implemented at each channel for receiving a sensing signal. The hybrid buffer circuit 104 may be configured to output a source signal or receive a sensing signal through the same channel.

The source driving module 102 includes a latch 20, a level shifter 22 and a DAC (Digital-Analog Converter) 24.

The latch 20 is configured to store display data DATA containing multiple bits inputted in series, and provide the display data DATA in parallel. The latch 20 include a combination of flip-flops which sequentially latch the multiple bits inputted in series and simultaneously output the multiple bits in parallel in synchronization with an output enable signal (not illustrated).

The level shifter 22 performs level shifting on the display data DATA. That is, the level shifter 22 serves to adjust the levels of the bit signals of the display data DATA which are stored in the latch 20 and then outputted in parallel, according to an input specification required by the DAC 24.

The DAC 24 is configured to select a gamma voltage corresponding to the display data DATA provided from the level shifter 22, and output the selected gamma voltage as a source signal. That is, the DAC 24 generates the source signal corresponding to the display data DATA.

The hybrid buffer circuit 104 includes the buffer 40 and switches SW1 to SW6.

The buffer 40 has a first input terminal, a second input terminal and an output terminal for outputting a source signal or pixel sensing signal.

The switches SW1 and SW2 constitute a selection circuit for the first input terminal of the buffer 40. The switch SW1 selectively provides a reference voltage Vref to the first input terminal of the buffer 40, and the switch SW2 selectively provides a source signal of the DAC 24 of the source driving module 102 to the first input terminal of the buffer 40.

The switches SW3 and SW4 constitute a selection circuit for the second input terminal of the buffer 40. The switch SW3 selectively forms a feedback path between the second input terminal and the output terminal of the buffer 40, and the switch SW4 selectively provides a pixel signal of the display panel 200 to the second input terminal of the buffer 40.

The switches SW5 and SW6 constitute a selection circuit for the output terminal of the buffer 40. The switch SW5 selectively connects the output terminal of the buffer 40 and the display panel 200 in order to output a source signal OUT1, and the switch SW6 selectively connects the output terminal of the buffer 40 and the conversion module 106 in order to output a pixel sensing signal OUT2.

In the above-described configuration, the switches SW4 and SW5 may output the source signal OUT1 to the display panel 200 and receive the pixel signal of the display panel 200 through the same channel CH_P of the source driver 100.

Figure 4:
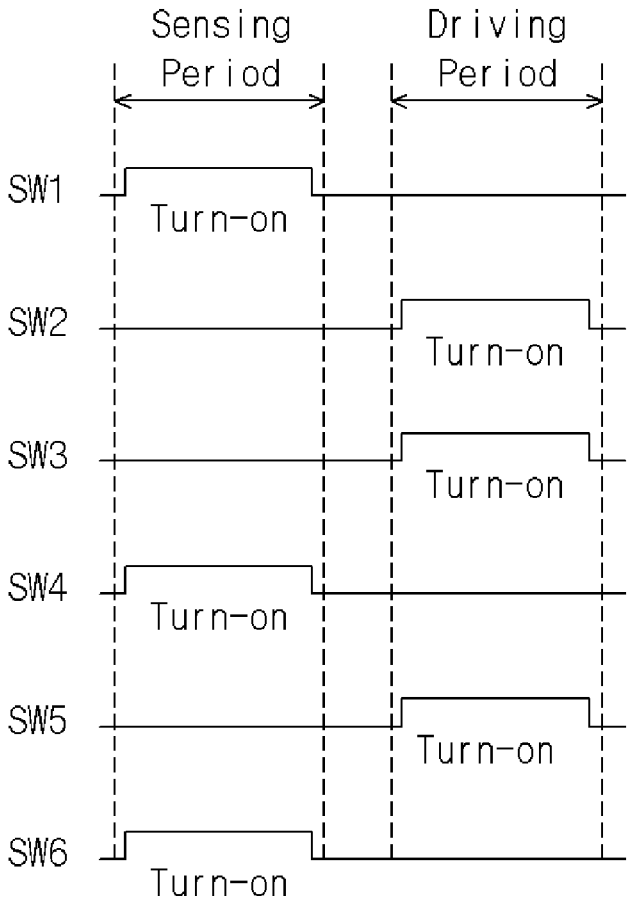
FIG. 4 is a waveform diagram for describing a switching operation of the source driver of FIG. 2.

The hybrid buffer circuit 104 may be controlled to turn on or off the switches SW1 to SW6 in response to the sensing period and the driving period, as illustrated in FIG. 4. The switching operations of the switches SW1 to SW6 may be controlled by control data of the display data DATA or control signals which are provided according to transmission states of data.

For example, the sensing period and the driving period may be alternately and periodically repeated on one horizontal cycle of display data DATA. One horizontal period may be divided into a blank period in which no display data are present and a display period in which one horizontal cycle of display data are present. Thus, the sensing period may be included in the blank period, and the driving period may correspond to the display period.

The switches SW1, SW4 and SW6 of the hybrid buffer circuit 104 may be turned on at the sensing period, and the switches SW2, SW3 and SW5 of the hybrid buffer circuit 104 may be turned on at the driving period.

When the switches SW1, SW4 and SW6 are turned on at the sensing period, the buffer 40 of the hybrid buffer circuit 104 compares a pixel signal of the display panel 200, inputted to the second input terminal through a channel CH_P and the switch SW4, to the reference voltage Vref inputted to the first input terminal through the switch SW1, and provides the comparison result as a pixel sensing signal OUT2 to the conversion module 106 through the switch SW6. At this time, the pixel signal may be understood as a current, and the buffer 40 may serve as a sensor for sensing the pixel signal or a buffer for transmitting the pixel signal to a sensor 60 included in the conversion module 106. The sensor 60 will be described later.

When the switches SW2, SW3 and SW5 are turned on at the driving period, the buffer 40 of the hybrid buffer circuit 104 drives the source signal of the DAC 24, inputted to the first input terminal through the switch SW2, and outputs the source signal OUT1 to the display panel 200 through the switch SW5. At this time, the buffer 40 may serve as an output buffer for the source driving module 102.

The conversion module 106 may include the sensor 60 and an ADC (Analog-Digital Converter) 70.

The sensor 60 is configured to sense the pixel sensing signal OUT2 provided from the buffer 40 and provide a sensing signal SEN_O for conversion into sensing data.

For this operation, the sensor 60 may include a transistor Q1 and a current sensor 62. The transistor Q1 may receive the pixel sensing signal OUT2 of the buffer 40 through the switch SW6 using the gate thereof, and control a current flow between the channel CH_P and the current sensor 62.

According to the above-described configuration, the current sensor 62 senses the amount of current based on the operation of the transistor Q1, and outputs the sensing signal SEN_O. For example, the current sensor 62 may generate the sensing signal SEN_O by integrating or sampling the amount of current flowing through the transistor Q1.

The ADC 70 converts the sensing signal SEN_O into sensing data OUT3.

For this operation, the ADC 70 includes a comparator 72, a register 74 and a DAC 76. The register 74 may be implemented with a successive approximation register.

The comparator 72 compares a comparison sensing signal outputted from the DAC 76 to the sensing signal SEN_O provided from the current sensor 62 and provides the comparison result to the register 74, for the sensing period.

The register 74 is configured to store sensing data of the previous cycle, update the sensing data by reflecting the comparison result of the comparator 72 into the sensing data, and output the updated sensing data OUT3.

The DAC 76 receives the sensing data of the previous cycle from the register 74, converts the received data, and provides the conversion result as the comparison sensing signal to the comparator 72.

According to the above-described configuration, the comparator 72 may compare the sensing signal SEN_O of the current cycle to the comparison sensing signal of the previous cycle, and provide the comparison result corresponding to a difference therebetween to the register 74, and the register 74 may output the sensing data OUT3 which are periodically updated.

According to the above-described configuration, the hybrid buffer circuit 104 may have the function of the output buffer to provide the source signal OUT1 to the display panel 200 in response to the driving period and the function of the buffer to provide the pixel signal of the display panel 200 as the pixel sensing signal OUT for the sensing operation in the sensor 60 in response to the sensing period.

When the buffer 40 of the hybrid buffer circuit 104 is implemented with a sensor, the pixel sensing signal OUT2 of the buffer 40 may be provided as a sensing signal to the ADC 70 of the conversion module 106, and the ADC 70 may generate the sensing data OUT3 by analog-digital converting the pixel sensing signal OUT2.

Figure 5:
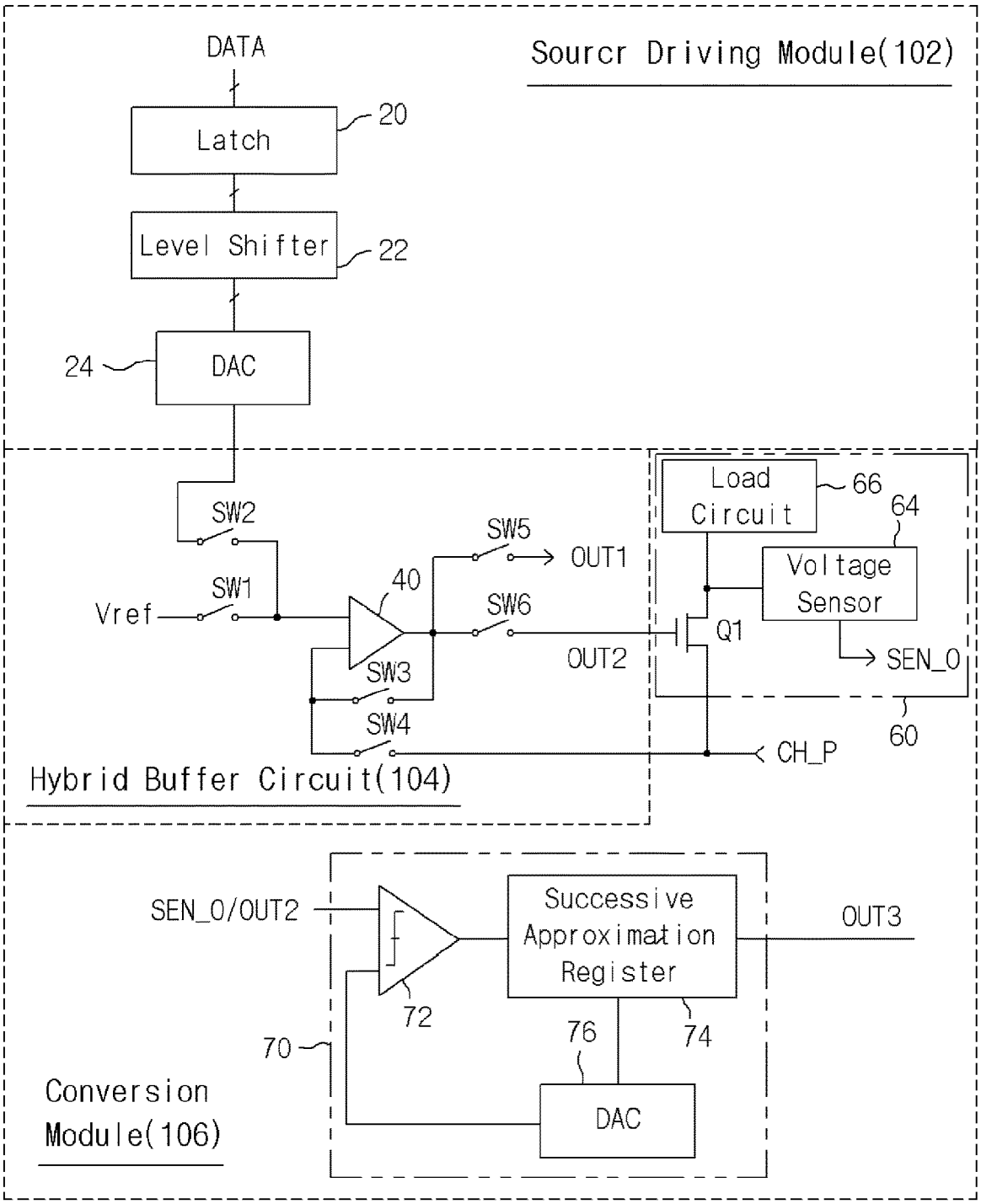
FIG. 5 is a detailed block diagram of a source driver according to another embodiment of the present invention.

In the present embodiment, the sensor 60 may be configured as illustrated in FIG. 5.

Figure 3:
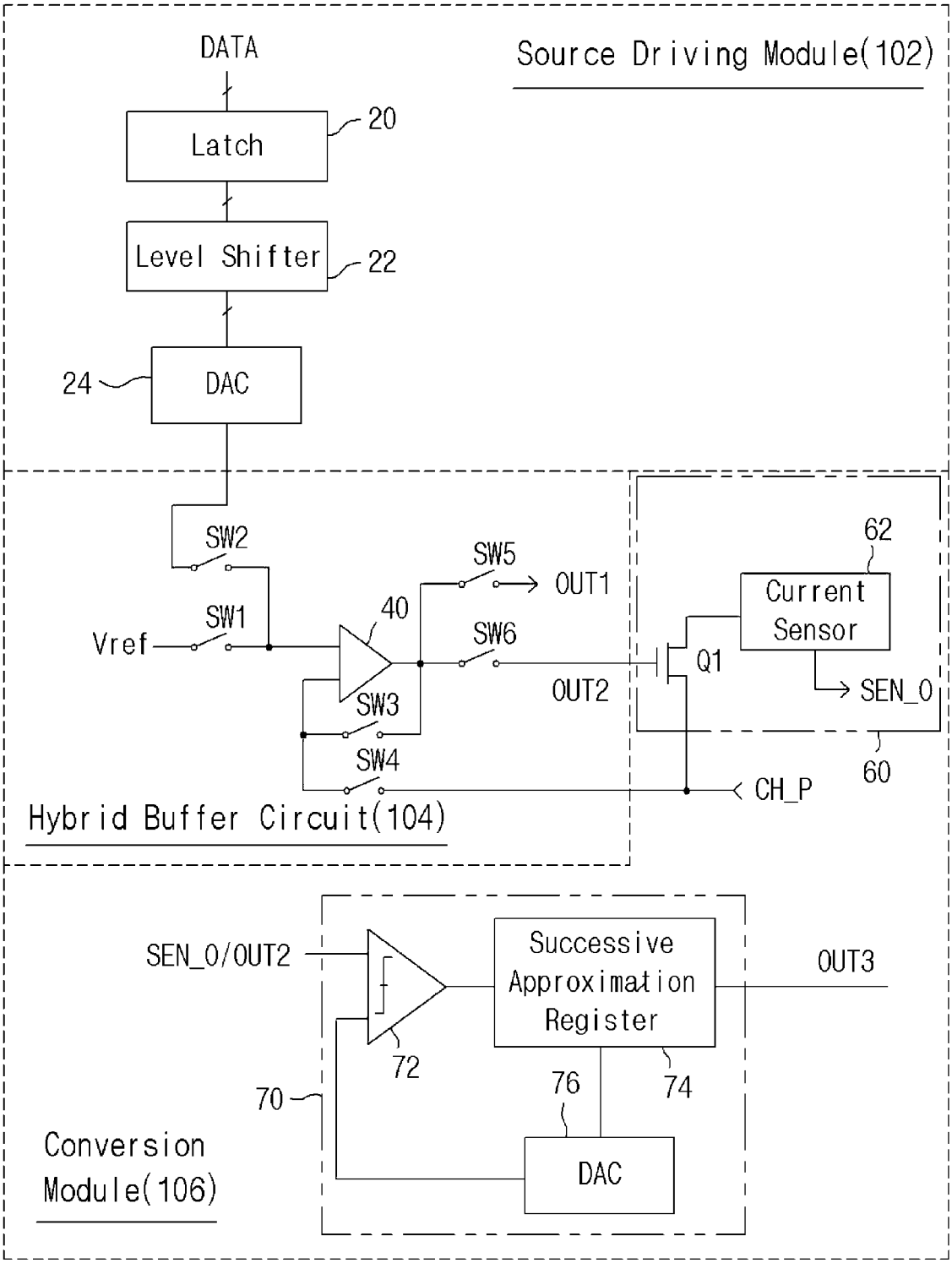
FIG. 3 is a detailed block diagram of the source driver of FIG. 2.

The embodiment of FIG. 5 may have the same configuration as the embodiment of FIG. 3, except for the sensor 60. In the embodiment of FIG. 5, the descriptions of the configurations and operations of the same components as those of FIG. 3 are omitted.

In the embodiment of FIG. 5, the sensor 60 may include a transistor Q1, a voltage sensor 64 and a load circuit 66.

The transistor Q1 may receive the pixel sensing signal OUT2 of the buffer 40 through the switch SW6 using the gate thereof, and control a current flow between the channel CH_P and the load circuit 66.

The load circuit 66 may include a constant current source, and the voltage sensor 64 may be configured to sense a voltage change of the load circuit, corresponding to the amount of current flowing through the transistor Q1.

According to the above-described configuration, the voltage sensor 64 may generate the sensing signal SEN_O by sensing the voltage change of the load circuit 66 through the operation of the transistor Q1 in response to the pixel sensing signal OUT2.

In the above-described configuration, the voltage sensor 64 may include a comparator. When the voltage sensor 64 includes a comparator, the comparator may be configured to generate the sensing signal SEN_O as a comparison result between a reference voltage of the load circuit 66 and the voltage change of the load circuit 66.

In the embodiments according to the present invention, the buffer 40 is commonly used for the operation of driving the source signal of the source driving module 102 and the operation of sensing the pixel signal of the display panel 200.

That is, one buffer may be used for outputting a source signal to the display panel at the driving period or used for receiving or sensing a pixel signal at the sensing period. Thus, an area required for designing the configurations of the source driving module and the sensor for each channel can be reduced, and the internal circuits of the source driver can be efficiently designed.

While various embodiments have been described above, it will be understood to those skilled in the art that the embodiments described are by way of example only. Accordingly, the disclosure described herein should not be limited based on the described embodiments.

What is claimed is:

1. A source driver for a display apparatus, the source driver comprising:

a source driving module configured to generate a source signal corresponding to display data;

a conversion module configured to generate sensing data corresponding to a pixel sensing signal; and a hybrid buffer circuit comprising a buffer and configured to provide the pixel sensing signal obtained by comparing a reference voltage and a pixel signal of a display panel using the buffer at a sensing period, and drive the source signal to the display panel using the buffer at a driving period, wherein the buffer transmits the pixel sensing signal to the conversion module at the sensing period and transmits the source signal to the display panel at the driving period, and wherein the hybrid buffer circuit comprises:

the buffer having first and second input terminals and an output terminal configured to output the source signal or the pixel sensing signal;

a first switch configured to selectively provide the reference voltage to the first input terminal;

a second switch configured to selectively provide the source signal of the source driving module to the first input terminal;

a third switch configured to selectively form a feedback path between the second input terminal and the output terminal;

a fourth switch configured to selectively provide the pixel signal to the second input terminal;

a fifth switch configured to selectively connect the output terminal and the display panel; and a sixth switch configured to selectively connect the output terminal and the conversion module.

2. The source driver of claim 1, wherein the hybrid buffer circuit turns on the first, fourth and sixth switches at the sensing period, and turns on the second, third and fifth switches at the driving period.

3. The source driver of claim 1, wherein the conversion module comprises an ADC (Analog-Digital Converter), and generates the sensing data by analog-digital converting the pixel sensing signal provided at the sensing period.

4. The source driver of claim 1, wherein the conversion module comprises a sensor, and the sensor senses the pixel sensing signal provided from the buffer and provides a sensing signal for conversion into the sensing data.

5. The source driver of claim 4, wherein the sensor comprises:

a transistor driven by the pixel sensing signal; and a current sensor configured to sense a current amount based on an operation of the transistor and provide the sensing signal.

6. The source driver of claim 4, wherein the sensor comprises:

a transistor driven by the pixel sensing signal;

a load circuit configured to receive a voltage corresponding to a current amount based on the operation of the transistor; and a voltage sensor configured to provide the sensing signal corresponding to the voltage of the load circuit.

7. The source driver of claim 6, wherein the voltage sensor comprises a comparator.

8. The source driver of claim 6, wherein the hybrid buffer circuit outputs the source signal to the display panel and receives the pixel signal of the display panel, through a same channel.

9. A source driver for a display apparatus, comprising:

a buffer having first and second input terminals and an output terminal configured to output a source signal or pixel sensing signal;

a first selection circuit configured to provide a reference voltage to the first input terminal at a sensing period and provide the source signal to the first input terminal at a driving period, the source signal being outputted from a DAC (Digital-Analog Converter) in response to display data;

a second selection circuit configured to provide a pixel signal of a display panel to the second input terminal at the sensing period and form a feedback path between the output terminal and the first input terminal at the driving period, an ADC configured to receive the pixel sensing signal of the output terminal and generate sensing data by analog-digital converting the pixel sensing signal; and a third selection circuit configured to transmit the pixel sensing signal of the output terminal to the ADC at the sensing period, and transmit the source signal of the output terminal to the display panel at the driving period, wherein the first selection circuit comprises a first switch configured to provide the reference voltage to the first input terminal at the sensing period and a second switch configured to transmit the source signal to the first input terminal at the driving period, the second selection circuit comprises a third switch configured to form a feedback path between the second input terminal at the output terminal at the driving period and a fourth switch configured to provide the pixel signal to the second input terminal at the sensing period, and the third selection circuit comprises a fifth switch configured to transmit the source signal of the output terminal to the display panel at the driving period and a sixth switch configured to transmit the pixel sensing signal of the output terminal to the ADC at the sensing period.

10. A source driver for a display apparatus, comprising:

a buffer having first and second input terminals and an output terminal configured to output a source signal or pixel sensing signal;

a first selection circuit configured to provide a reference voltage to the first input terminal at a sensing period and provide the source signal to the first input terminal at a driving period, the source signal being outputted from a DAC in response to display data;

a second selection circuit configured to provide a pixel signal of a display panel to the second input terminal at the sensing period and form a feedback path between the output terminal and the first input terminal at the driving period;

a sensor configured to receive the pixel sensing signal of the output terminal, sense the pixel sensing signal, and provide a sensing signal for conversion into sensing data; and a third selection circuit configured to transmit the pixel sensing signal of the output terminal to the sensor at the sensing period, and transmit the source signal of the output terminal to the display panel at the driving period, wherein the first selection circuit comprises a first switch configured to provide the reference voltage to the first input terminal at the sensing period and a second switch configured to transmit the source signal to the first input terminal at the driving period, the second selection circuit comprises a third switch configured to form a feedback path between the second input terminal at the output terminal at the driving period and a fourth switch configured to provide the pixel signal to the second input terminal at the sensing period, and the third selection circuit comprises a fifth switch configured to transmit the source signal of the output terminal to the display panel at the driving period and a sixth switch configured to transmit the pixel sensing signal of the output terminal to the ADC at the sensing period.

11. The source driver of claim 10, wherein the sensor comprises:

a transistor driven by the pixel sensing signal; and a current sensor configured to sense a current amount based on an operation of the transistor and provide the sensing signal.

12. The source driver of claim 10, wherein the sensor comprises:

a transistor driven by the pixel sensing signal;

a load circuit configured to receive a voltage corresponding to a current amount based on an operation of the transistor; and a voltage sensor configured to provide the sensing signal corresponding to the voltage of the load circuit.

13. The source driver of claim 10, wherein the fourth and fifth switches output the source signal to the display panel and receive the pixel signal of the display panel, through a same channel.

* * * * *